United States Patent [19]

Shashkina et al.

[11] 4,212,758

[45] Jul. 15, 1980

[54] CLEANSING AGENTS CONTAINING OLEIC ACID, ISOPROPANOL AND ETHYLACETATE

[76] Inventors: Valentina G. Shashkina, ulitsa Michurina, 23/25, kv. 92, Riga; Gunta Y. Neimane, ulitsa Padomju, 8, kv. 1, Rizhsky raion, Inchukalns; Petr I. Belkevich, ulitsa Kulman, 15, kv. 55, Minsk; Fanya L. Kaganovich, ulitsa Kozlova, 8/1, kv. 88, Minsk; Elena F. Dolidovich, ulitsa D. Serdicha, 3, kv. 58, Minsk; Ljudmila S. Sheremet, ulitsa Slavinskogo, 17, kv. 223, Minsk; Viktor J. Yachnik, Pukhovichsky raion, poselok Svilosch, Minskaya oblast, all of U.S.S.R.

[21] Appl. No.: 953,070

[22] Filed: Oct. 20, 1978

[51] Int. Cl.[2] ..... C11D 3/60

[52] U.S. Cl. ..... 252/119; 252/89.1; 252/118; 252/120; 252/153; 252/154; 252/DIG. 5

[58] Field of Search ..... 252/118, 119, 120, 154, 252/153, DIG. 5, 89.1; 424/195

[56] References Cited

U.S. PATENT DOCUMENTS

| | | | |
|---|---|---|---|
| 2,032,042 | 2/1936 | Bishop | 252/153 |
| 2,244,721 | 6/1941 | Mitscherling | 252/153 |
| 2,548,766 | 4/1951 | Baum et al. | 252/118 X |
| 2,551,634 | 5/1951 | Price | 252/153 X |
| 2,825,696 | 3/1958 | Zabban et al. | 252/118 X |
| 3,663,445 | 5/1972 | Augustin et al. | 252/118 X |
| 3,840,465 | 10/1974 | Knowles et al. | 252/118 X |

OTHER PUBLICATIONS

Kaganovich et al., "Sterols of Peat Wax", Kaim. Tverd. Topl. 1974, (4), 67–69, CA. 82:75383d. 9.

*Primary Examiner*—Harris A. Pitlick

*Attorney, Agent, or Firm*—Ladas, Parry, Von Gehr, Goldsmith & Deschamps

[57] ABSTRACT

The cleansing agent comprises oleic acid, isopropyl alcohol, triethanolamine, ethanol extract of peat wax resin obtained by ethanol extraction of peat wax resin at a temperature of the alcohol boiling point, ethyl acetate, 1,2-pyropylene glycol, polyethyleneglycolic ether of synthetic fatty alcohols $C_{10}$–$C_{18}$, diethanolamides of synthetic fatty acids $C_{10}$–$C_{13}$, and water, the components being taken in the following quantities, in percent by weight:

| | |
|---|---|
| oleic acid | 10.0–13.0 |
| isopropyl alcohol | 19.0–21.0 |
| triethanolamine | 3.0–5.0 |
| ethanol extract of peat wax resin | 1.0–1.5 |
| ethyl acetate | 10.0–13.0 |
| 1,2-propylene glycol | 4.0–5.7 |
| polyethyleneglycolic ether of synthetic fatty alcohols $C_{10}$–$C_{18}$ | 4.0–5.5 |
| diethanolamides of synthetic fatty acids $C_{10}$–$C_{13}$ | 5.0–6.5 |
| water | to 100. |

The proposed cleansing agent is highly effective to clean plastics, metals, glass, and the skin from oils, carbon black, paints and lacquers, resins, and rusts.

4 Claims, No Drawings

CLEANSING AGENTS CONTAINING OLEIC ACID, ISOPROPANOL AND ETHYLACETATE

FIELD OF THE INVENTION

This invention relates to cleansing agents.

Said agents are widely used to clean the skin, that of hands in particular, from industrial contaminants containing oils, carbon black, paints, resins, and rust. Such cleansing agents are also successfully used to clean surfaces of plastics, metals and glass from said contaminants.

In using such cleansing agents it is very important that they should not irritate the human skin or cause its inflammation.

BACKGROUND OF THE INVENTION

Known in the prior art are various pastes and liquid compounds intended, for example, for hand cleaning. For examples use is made of a paste containing 16 percent by weight of $Na_2S_2O_4$, 10 percent by weight of $Na_2CO_3$, 10 percent by weight of $Na_2P_2O_7$, and 18 percent by weight of a mixture of monoethyl ethers of polyhydric alcohols admixed with glycerol, perfume oil, and kaolin. A disadvantage of this compound is that it can only be used to remove aniline dyes. It fails to remove many oils, paints, or carbon blacks.

Also known is another cleansing agent (detergent) comprising special additives which prevent, or at least decrease, the irritative effect on the skin. The active principle of such agents is, for example, a compound of univalent polar groups. The main disadvantage of this agent is that it fails to cleanse from specific contaminants such as paints, resins, etc.

There is known another cleansing agent comprising triethanolamine, lauryl/sulphate, an oil phase consisting of olive oil and clarified fractions of a mineral oil, sodium polyacrylate, and water. This cleansing agent is not sufficiently effective in cleansing heavily soiled hands, nor does it ensure rapid and complete removal of contaminants containing oils, soots, resins, or paints. Moreover, it does not contain useful additives which could disinfect the skin or produce any prophylactic action thereon.

A cleansing agent consisting of water, oleic acid, an aliphatic alcohol, triethanolamine, hexachlorophene and a scenting agent is quite effective. It cleans the skin from specific contaminants, such as carbon blacks, oils, resins, oil paints, but the presence of hexachlorophene in the composition of this cleansing agent produces irritation and sensitization of the skin.

SUMMARY OF THE INVENTION

The principal object of the invention is to provide a cleansing agent that will be effective in removing specific contaminants from the surfaces of plastics, metals, glass, etc., and also from the skin without doing any harm to the surfaces of said materials or to the human skin.

This object is attained in that in the proposed cleansing agent comprising oleic acid, an aliphatic alcohol, triethanolamine, a scenting agent, and water, according to the invention, isopropyl alcohol is used as the aliphatic alcohol, and the cleansing agent also contains an ethanol extract of peat wax resin obtained by ethanol extraction of peat wax resin at a temperature equal to the ethyl alcohol boiling point, ethyl acetate, 1,2-propylene glycol, polyethyleneglycolic ether of synthetic fatty alcohols $C_{10}$–$C_{18}$, and diethanolamides of synthetic fatty acids $C_{10}$–$C_{13}$, the components being taken in the following proportion, in percent by weight:

| | |
|---|---|
| oleic acid | 10.0–13.0 |
| isopropyl alcohol | 19.0–21.0 |
| triethanolamine | 3.0–5.0 |
| ethanol extract of peat wax resin | 1.0–1.5 |
| ethyl acetate | 10.0–13.0 |
| 1,2-propylene glycol | 4.0–5.7 |
| polyethyleneglycolic ether of synthetic fatty alcohols $C_{10}$–$C_{18}$ | 4.0–5.5 |
| diethanolamides of synthetic fatty acids $C_{10}$–$C_{13}$ | 5.0–6.5 |
| water | to 100. |

The proposed cleansing agent effectively cleans the surfaces of plastics, metals, glass, and the skin from specific contaminants.

Oleic acid ensures uniform distribution of the whole compound over the surface and produces a softening effect on the skin. Moreover, oleic acid promotes foaming, which adds to the effectiveness and speed of the cleaning operation. If the cleansing agent contains more than 11 percent by weight of oleic acid, it is poorly washed off with water. If the acid is contained in a quantity less than 10 percent by weight, the cleansing agent properties are deteriorated.

Ethyl acetate facilitates quick removal of specific contaminants which are otherwise difficult to remove. These are, for example, paints, and resins.

Raising the ethyl acetate content of the cleansing agent above the specified limit does not improve the cleaning properties but only produces a drying action on the skin.

Isopropyl alcohol, in combination with ethyl acetate, also ensures quick and effective decontamination.

The ethanol extract of peat wax resin contains biologically potent substances, vegetable sterols, phytosterols, mainly $\beta$-sytosterols. The extract produces a positive action on the human skin. It softens the skin, accelerates healing of wounds and minor injuries, prevents and controls skin diseases.

Triethanolamine, in combination with other surfactants, polyethyleneglycolic ethers of synthetic fatty alcohols $C_{10}$–$C_{18}$ and diethanolamides of synthetic fatty acids $C_{10}$–$C_{13}$, promotes the rapid foaming which ensures the high cleansing effect, produces a wetting action, and exhibits good emulsifying and dispersing properties.

If the components are taken in quantities higher than specified, the cleansing properties of the proposed agent are not improved, but it can produce an adverse effect on the skin. The skin contracts and erythema can develop. The cleansing agent becomes difficult to wash off and the hand washing becomes longer.

1,2-propylene glycol improves the solubility of contaminants in water solutions and ensures easy removal of soil. Moreover, this substance softens the skin. The specified proportion of this substance is the optimum to attain the wanted results.

To remove the unpleasant odour of the cleansing agent, which is due to isopropyl alcohol and ethyl acetate, an aromatic substance, for example, lavender oil (0.05–0.1 percent by weight) should be added.

The proposed cleansing agent can be conveniently used in aerosol form. This ensures quick formation of homogeneous foam which easily removes solids even from deep folds of the skin without doing any harm to it.

The cleansing agent in aerosol form is convenient in transportation and storage. Furthermore, the use of aerosol saves the cleansing agent. Difluorochloromethane is recommended to be used as the propellant in a quantity of 10–15 percent by weight.

The proposed cleansing agent has a complex of useful properties. It is highly efficient to remove oils, carbon black, paints, resins, rust, and other common contaminants from plastics, metals, glass, and the skin.

When used to clean the skin, it produces prophylactic action to prevent skin diseases (the skin is not irritated or sensitized; minor injuries and cuts are healed faster).

The use of the proposed cleaning agent does not require additional treatment with softening substances.

When the cleansing agent is in aerosol form and contained in special bottles, it can be easily used to clean hands from lubricants, materials used in light printing and from various domestic soiling substances.

Detailed Description of the Invention

The method for preparing the cleansing agent according to the invention is realized as follows.

A reactor provided with a jacket and a stirrer is loaded with oleic acid and ethyl acetate, and the stirrer is started. Now an ethanol extract of peat wax resin and isopropyl alcohol are added with agitation. Next, 1,2-propylene glycol, triethanoamine, polyethyleneglycolic ether of synthetic fatty alcohols $C_{10}$–$C_{18}$ and diethanolamides of synthetic fatty acids $C_{10}$–$C_{13}$ are added to the agitated mixture. The obtained mixture is stirred until a homogeneous clear solution is obtained, the temperature in the jacket being maintained at 25°–30° C. The obtained solution is cooled to 20° C. and a predetermined quantity of water and the scenting agent, if any, are added to the stirred mixture. The finished cleansing agent is discharged into a receptacle from where it is filled into commercial containers.

If the cleansing agent is to be filled into aerosol bottles, the finished solution is delivered from the receptacle into a batching device, from where it is filled into the bottles provided with valves. The bottles are then filled with difluorochloromethane.

The ethanol extract of peat wax resin is prepared as follows.

An extractor provided with a reflux condenser and a stirrer is loaded with peat wax resin and five-fold quantity of ethyl alcohol. The components are mixed for five hours at a temperature equal to the ethanol boiling point. The extractor is heated with live steam. Then, the extract is drained and the extraction is repeated twice. The resultant product is a two-phase suspension the upper layer of which is the ethanol extract of peat wax resin. The extracts are mixed together, and the solvent is skimmed therefrom.

For a better understanding of the invention the following examples of its practical embodiment are given by way of illustration.

EXAMPLE 1

A cleansing agent having the following composition, in percent by weight, is prepared:

| | |
|---|---|
| oleic acid | 13.0 |
| isopropyl alcohol | 19.0 |
| triethanolamine | 5.0 |
| ethanol extract of peat wax resin | 1.25 |
| ethyl acetate | 13.0 |
| 1,2-propylene glycol | 5.0 |
| polyethyleneglycolic ether of synthetic fatty alcohols $C_{10}$—$C_{18}$ | 4.5 |
| diethanolamides of synthetic fatty acids $C_{10}$—$C_{13}$ | 5.0 |
| water | 34.25 |

The cleansing agent of the above specified composition is highly effective to clean plastics, metals, glass surfaces and the skin from oils, carbon blacks, varnishes and laquers, and also domestic contaminants.

When the proposed cleansing agent is used to treat hands, it is easily washed off with water at any temperature, adequately removes dirt from deep folds without doing any harm to the skin. No additional treatment with any other means is required after treatment with the proposed cleansing agent. The skin natural functions are rapidly restored after washing.

EXAMPLE 2

A cleansing agent having the following composition, in percent by weight, is prepared:

| | |
|---|---|
| oleic acid | 12.0 |
| isopropyl alcohol | 21.0 |
| triethanolamine | 4.5 |
| ethanol extract of peat wax resin | 1.0 |
| ethyl acetate | 13.0 |
| 1,2-propyleneglycol | 4.0 |
| polyethyleneglycolic ether of synthetic fatty alcohols $C_{10}$—$C_{18}$ | 5.0 |
| diethanolamides of synthetic fatty acids $C_{10}$—$C_{13}$ | 5.5 |
| scenting agent (aromatic substance) | 0.10 |
| water | 33.9 |

The cleansing agent of the specified composition is highly effective in cleaning plastic, metallic, and glass surfaces, as well as the skin from oils, carbon black, lacquers and varnishes, rust, and domestic contaminants.

The cleansing agent is easy to wash off with water at any temperature and of any hardness, it adequately removes dirt from deep folds without doing any harm to the skin (no reddening or irritation). No other means are required after treatment with the proposed cleansing agent. The acid and fat medium of the hands is quickly restored after using the proposed agent. The aromatic substance contained in the cleansing agent masks the odour of the solvent and adds to its valuable properties.

EXAMPLE 3

A cleansing agent of the following composition, in percent by weight, is prepared:

| | |
|---|---|
| oleic acid | 10.5 |
| isopropyl alcohol | 20.0 |
| triethanolaminde | 3.5 |
| ethanol extract of peat wax resin | 1.5 |
| ethyl acetate | 10.5 |
| 1,2-propylene glycol | 4.5 |
| polyethyleneglycolic ether of synthetic fatty alcohols $C_{10}$—$C_{18}$ | 4.0 |
| diethanolamides of synthetic fatty acids $C_{10}$—$C_{13}$ | 6.0 |

-continued

| | |
|---|---|
| difluorodichloromethane | 25.0 |

The cleansing agent of the specified composition is highly effective to clean plastic, metallic, and glass surfaces as well as hands from oils, carbon black, oil paints, and domestic contaminants, such as ball-point pen ink.

The cleansing agent is easy to wash off with water of any hardness and at any temperature, it effectively removes dirt from deep folds of the skin without doing any harm to it. No additional treatment with any other agents is required after use of the proposed cleansing agent. Natural function of the skin is rapidly restored after use of the proposed agent.

EXAMPLE 4

The cleansing agent of the following composition, in percent by weight, is prepared:

| | |
|---|---|
| oleic acid | 11.0 |
| isopropyl alcohol | 19.0 |
| triethanolamine | 3.0 |
| ethanol extract of peat wax resin | 1.0 |
| ethyl acetate | 10.5 |
| 1,2-propylane glycol | 5.0 |
| polyethyleneglycolic ether of synthetic alcohols $C_{10}$—$C_{18}$ | 4.5 |
| diethanolamides of synthetic fatty acids $C_{10}$—$C_{13}$ | 5.0 |
| scenting agent | 0.05 |
| water | 30.95 |
| difluorochloromethane | 10.0 |

The cleansing agent of the specified composition is highly effective to clean plastic, metallic, and glass surfaces, and also the skin from oils, carbon black, lacquers, varnishes, enamels, aniline dyes, resins, rusts, graphite lubricants, and domestic contaminants.

Difluorochloromethane promotes formation of fine foam which facilitates the easy and soft distribution of the cleansing agent over the surfaces. The cleansing agent is easy to wash off with water of any hardness and at any temperature. The cleansing agent removes dirt even from deep folds of the skin. No additional cleaning or oiling means are required after the use of the proposed cleansing agent. The natural skin function is rapidly restored.

What is claimed is:

1. A cleansing agent comprising oleic acid, isopropyl alcohol, triethanolamine, ethanol extract of peat wax resin obtained by the ethanol extraction of peat wax resin at a temperature of the alcohol boiling point, ethyl acetate, 1,2-propylene glycol, polyethyleneglycolic ether of synthetic fatty acids $C_{10}$–$C_{18}$, diethanolamides of synthetic fatty acids $C_{10}$–$C_{13}$, and water, the components being taken in the following quantities, in percent by weight:

| | |
|---|---|
| oleic acid | 10.0–13.0 |
| isopropyl alcohol | 19.0–21.0 |
| triethanolamine | 3.0–5.0 |
| ethanol extract of peat wax resin | 1.0–1.5 |
| ethyl acetate | 10.0–13.0 |
| 1,2-propylene glycol | 4.0–5.7 |
| polyethyleneglycolic ether of synthetic fatty alcohols $C_{10}$–$C_{18}$ | 4.0–5.5 |
| diethanolamides of synthetic fatty acids $C_{10}$–$C_{13}$ | 5.0–6.5 |
| water | to 100. |

2. A cleansing agent according to claim 1, which contains a scenting agent taken in a quantity of 0.05–0.1 percent by weight.

3. A cleansing agent according to claim 1, which contains difluorochloromethane in a quantity of 10–15 percent by weight.

4. A cleansing agent according to claim 2, which contains difluorochloromethane in a quantity of 10–15 percent by weight.

* * * * *